US006044877A

United States Patent [19]

Bennet

[11] Patent Number: 6,044,877

[45] Date of Patent: Apr. 4, 2000

[54] METHODS AND APPARATUS FOR OPENING AND SUPPORTING COLLAPSIBLE CONTAINERS

[76] Inventor: Roger Bennet, 105 N. Clearwater Dr., Highland Village (Denton County), Tex. 75077

[21] Appl. No.: 09/172,919

[22] Filed: Oct. 14, 1998

[51] Int. Cl.[7] ..... B65D 3/04

[52] U.S. Cl. ..... 141/390; 141/10; 141/316; 141/391; 248/95; 248/97; 220/908; 220/908.3; 383/33; 383/104

[58] Field of Search ..... 141/10, 316, 390, 141/391; 383/33, 104; 248/95, 97, 99; 220/908, 908.3

[56] References Cited

U.S. PATENT DOCUMENTS

| | | | |
|---|---|---|---|
| 3,627,243 | 12/1971 | Farrell | 248/99 |
| 3,659,816 | 5/1972 | Wilson | 248/97 |
| 3,893,648 | 7/1975 | Gilbert | 248/97 |
| 3,983,914 | 10/1976 | Benson | 141/390 |
| 4,628,007 | 12/1986 | Ledsham | 141/390 |
| 4,749,011 | 6/1988 | Rylander | 141/316 |
| 4,955,496 | 9/1990 | Nelson | 141/390 |
| 5,226,554 | 7/1993 | Dauphinais | 248/95 |
| 5,513,822 | 5/1996 | Gould | 248/99 |
| 5,716,033 | 2/1998 | Gibson | 248/95 |

*Primary Examiner*—J. Casimer Jacyna
*Attorney, Agent, or Firm*—James J. Murphy, Esq.; Winstead Sechrest & Minick

[57] ABSTRACT

Apparatus 100 for opening and supporting a collapsible container 101 having a wall and opening for receiving items to be disposed. Apparatus 100 comprises a sheet of high impact plastic having a thickness selected such that when the sheet is coiled to form a helical spring, and inserted into the opening of the container and released, the sheet rapidly uncoils thereby opening the container and applying a firm outward pressure to the container wall.

20 Claims, 1 Drawing Sheet

METHODS AND APPARATUS FOR OPENING AND SUPPORTING COLLAPSIBLE CONTAINERS

BACKGROUND OF THE INVENTION

1. Field of the Invention

The present invention relates in general to containers and in particular to methods and apparatus for opening collapsible containers.

2. Description of the Related Art

Collapsible bags, such as plastic trash bags and cloth laundry bags, have been in use for many years. Plastic trash bags have been particularly popular because of their convenience. Among other things, plastic bags in their collapsed form are easy to package for sale and easy to store. Moreover, they come is a range of sizes, from the large bags intended for disposing of leaves and similar yard trash to the smaller bags used in the household for disposing of kitchen waste and similar refuse. Once filled with refuse, the opening in the trash bag need only be fastened closed, for example with a twist tie, and the entire package appropriately sent for final disposal.

Even in light of their substantial advantages, there are many problems with the construction and use of plastic trash bags. First of all, because they are collapsible, the must be supported by a trash can or barrel, at least until they are substantially filled. In addition to support for the collapsible walls, a can or barrel is also normally required to maintain the bag opening spread wide enough for refuse to easily be inserted. Further, the thin walls of plastic are easily punctured or cut when sharp objects are tossed in to the bag. Finally, plastic bags are often difficult to open because the plastic walls typically stick together, especially at the lower extremities which are difficult to reach by hand.

Several ideas have been put forth for dealing the problem of supporting empty or near empty trash bags without the need for a trash bin or can. One of these ideas is embodied in U.S. Pat. No. 4,457,483 to Gagne. Here, a sheet of flexible plastic is rolled and then inserted into the opening of a trash bag as the support structure. This design however has at least two major disadvantages. First, the bag must be expanded by hand or by forcing the cylinder of plastic apart by hand after insertion into the bag. Second, because the plastic tube tends to collapse back into the coiled position, fasteners are required to keep the plastic uncoiled and the bag expanded.

A similar idea is disclosed in U.S. Pat. No. 5,226,554 to Dauphanis. In this case a sheet of strong flexible material is used as a trash bag liner. Specifically, the liner is made of polyethylene, which even if rolled, does not expand rapidly and generate enough force to completely open the trash bag from the opening to the bottom. Moreover, "locks" are provided to keep the ends of the liner together and the structure rigid.

Thus, the need has arisen for apparatus and methods for opening and supporting collapsible containers, such as plastic trash bags. Such apparatus and methods should be able to separate adjacent walls of the container, even if they are temporarily adhering to each other, quickly and with minimal hand work by the user. Further, these methods and apparatus should not require the use of fasteners for either maintaining support of the bag or the structural integrity of the apparatus itself.

BRIEF SUMMARY OF THE INVENTION

Principles of the present invention provide for methods and apparatus for opening and supporting collapsible containers, such as plastic trash bags, cloth laundry bags, and the like.

According to one embodiment of the present invention, an apparatus is disclosed for opening and supporting a collapsible container having a wall and an opening for receiving items to be disposed. The apparatus comprises a sheet of high impact plastic having a thickness selected such that when the sheet is coiled to form a helical spring, inserted into the opening of the container, and released, the sheet rapidly uncoils thereby popping open the container and applying a firm outward pressure to the container wall.

According to an additional embodiment of the present invention, a trash bag popper is disclosed comprising a sheet of high impact styrene of a thickness selected such that the sheet comprises a helical spring with a potential energy when rolled, the helical spring when released popping open a trash bag into which the helical spring has been inserted.

The present inventive principles are also embodied in methods for opening and supporting collapsible containers. According to one such method, a plastic sheet is fabricated such that when the sheet is coiled a helical spring is created having a spring constant sufficient to allow the spring to uncoil with a sufficient force to pop open the collapsible container. The plastic sheet is coiled to create the helical spring, inserted into an opening in the collapsible container, and then released to pop open in the container.

The concepts of the present invention provide substantial advantages over the prior art. Among other things, apparatus and methods are disclosed for separating adjacent walls of a collapsible container, even if those walls are temporarily adhering to each other, in a quick and efficient fashion. Further, such methods and apparatus do not require the use of fasteners for either maintaining support of the bag or the structural integrity of the supporting apparatus itself.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
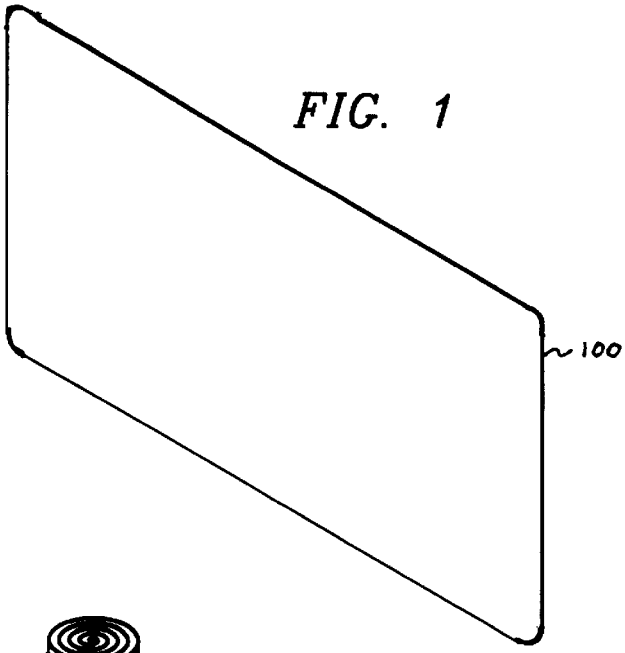
FIG. 1 depicts a plan view of a trash bag opener/support (popper)

The principles of the present invention and their advantages are best understood by referring to the illustrated embodiment depicted in FIGS. 1–2 of the drawings, in which like numbers designate like parts.

Figure 2A:
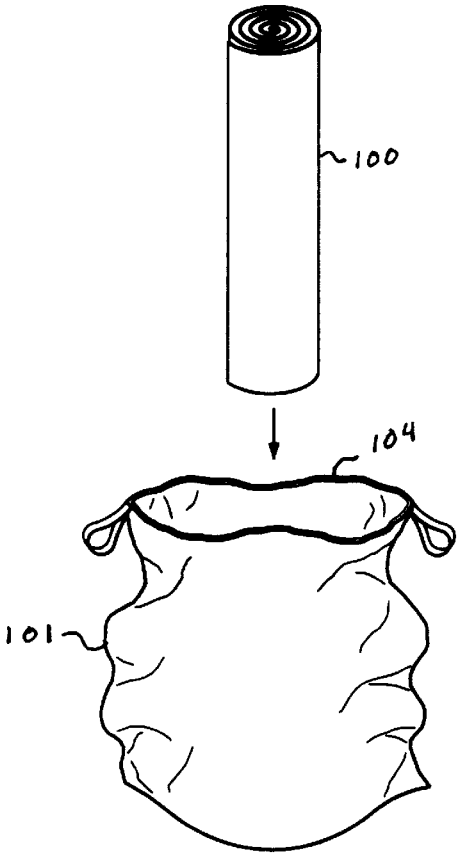
FIG. 2*a* depicts popper of FIG. 1 the fully coiled state.
Figure 2B:
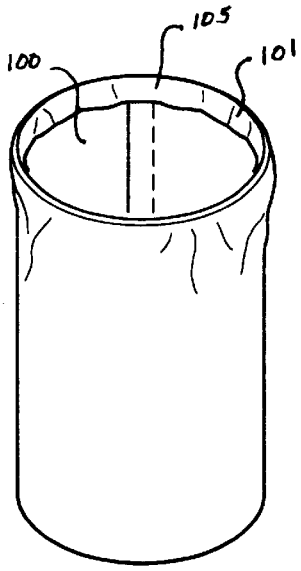
FIG. 2*b* depicts the partially uncoiled state of the popper of FIG. 1, where popper is supporting a container by asserting a radial pressure to the container walls.
Figure 2C:
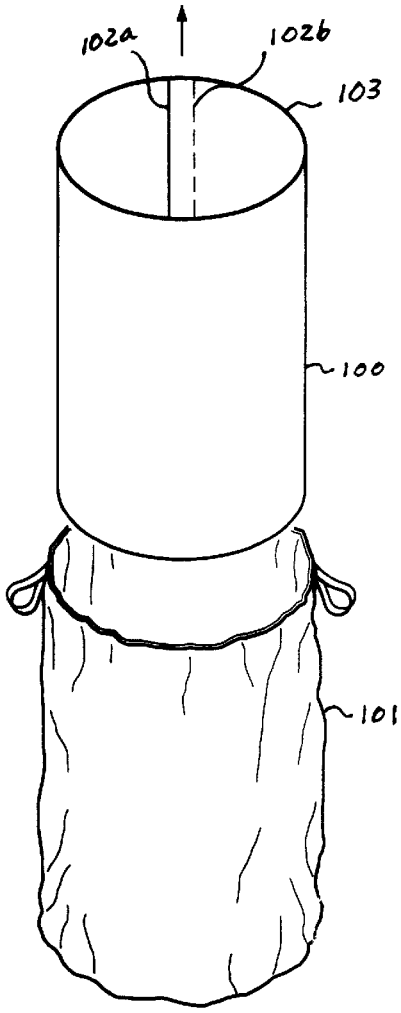
FIG. 2*c* demonstrates the removal of the popper from the container.

FIG. 1 is a plan view of a trash bag opener/support (popper) 100 according the concepts of the present invention. Here, trash bag opener 100 is shown in the relaxed state, in which it is generally flat. The fully coiled state is shown in FIG. 2*a*, where popper is being inserted into a collapsible bag or container 101. The partially uncoiled state, where popper 100 is supporting container 101 by asserting a radial pressure to the walls of container 101 is shown in FIG. 2*b*. Additionally, FIG. 2*c* demonstrates the removal of popper from a filled or partially filled container 101.

According to the invention, popper 100 Is formed of a selected material which normally returns to the flat relaxed state after being coiled, rolled or bent. In the preferred embodiment, trash bag popper 100 comprises a sheet of high impact plastic, such as styrene, which when coiled produces a relatively high elastic potential energy. The thickness of the material is selected such that it is not so thick that it cannot be rolled-up and yet not so thin that it will not, when released, contour to the walls of the trash bag. In the preferred embodiment where high impact styrene is used, the sheet thickness is about 0.045 inches. Not only does the material rapidly uncoil when released from the coiled state, but also applies a firm and constant radial pressure at the walls of the given bag. No fasteners are required to either keep popper 100 attached to the bag wall or to keep the ends of popper 100 together.

The length and width of popper 100 are determined as a function of the size of trash bag it is preferably intended to be used with. For example, for a thirty-nine (39) gallon plastic trash bag normally used for disposing leaves and yard trash, the dimensions are approximately twenty-nine inches (29") by seventy-two inches (72"). The length is generally selected such that the ends 102*a* and 102*b* of popper 100 overlap by at least one inch when opener/support is allowed to expand from the coiled state out to the walls of the trash bag. The width is selected such that an overhang of a few inches, for example four inches (4") in the case of a 39 gallon example, between the side edge 103 of popper 100 and the edge 104 of the opening into container 101. The overhang is shown generally at 105.

In sum, popper 100 has several substantial advantages over the prior art. Among other things, the use of high impact plastic provides a high spring constant, such that when coiled, a helical spring with high potential elastic energy is created. This allows opener/support 100 to expand rapidly thereby splitting apart the walls of the bag, even if stuck together. Moreover, one expanded, a constant and firm pressure is applied to the bag walls, which not only provides the required support structure, but also insures that the bag is open to its full extent thereby maximizing the usable volume of the bag. The high impact plastic prevents punctures and tears of the bag wall. Additionally, because popper 100 returns to a substantially flat condition after removal from the surrounding container, it can be used for other household applications requiring a roughed high impact plastic surface. Finally, it should be noted that popper 100 eliminates a frequent problem found in the use of a can or bin for supporting the bag, namely, the difficulties in removing the filled bag from the bin or can due to the vacuum that forms as the bag is pulled out.

Although the invention has been described with reference to a specific embodiments, these descriptions are not meant to be construed in a limiting sense. Various modifications of the disclosed embodiments, as well as alternative embodiments of the invention will become apparent to persons skilled in the art upon reference to the description of the invention. It is therefore, contemplated that the claims will cover any such modifications or embodiments that fall within the true scope of the invention.

What is claimed is:

1. Apparatus for opening and supporting a collapsible container having a wall and an opening for receiving items to be disposed of comprising:

a sheet of high impact plastic having a thickness selected such that when said sheet is coiled to form a helical spring and inserted into said opening of said container when said container is in a substantially collapsed state and released, said sheet rapidly uncoils thereby opening said container and applying a firm outward pressure to said wall as a function of spring action to maintain said container in an open condition.

2. The apparatus of claim 1 wherein a length of said sheet is selected such that first and second end edges of said sheet overlap when said sheet is uncoiled.

3. The apparatus of claim 1 wherein a width of said sheet is selected such that an overhang is created between a side edge of said sheet when said sheet is uncoiled within said container and an edge of said opening of said container.

4. The apparatus of claim 1 wherein said plastic comprises high impact styrene.

5. The apparatus of claim 1 wherein said container comprises a plastic trash bag.

6. The apparatus of claim 1 wherein a thickness of said sheet is about 0.045 inches.

7. The apparatus of claim 1 wherein said container has a volume of about 39 gallons and said sheet has a length of about 70 inches and a width of about 29 inches.

8. The apparatus of claim 1 wherein said container comprises a laundry bag.

9. A trash bag popper comprising:

a sheet of high impact styrene of a thickness selected such that said sheet comprises a helical spring with a potential energy when rolled, said helical spring when released popping opening a substantially collapsed trash bag into which said helical spring has been inserted and maintaining said trash bag in an open state as a function of spring action.

10. The popper of claim 9 wherein said sheet has a width and a length predetermined as a function of a size of said bag.

11. The popper of claim 10 wherein said width is selected such that first and second end edges of said sheet overlap by a predetermined amount when said helical spring has been released.

12. The popper of claim 10 wherein said length is selected such that said bag overhangs a side edge of said sheet when said helical spring has been released.

13. The popper of claim 9 wherein said sheet returns to a substantially flat state when unrestrained.

14. The popper of claim 9 wherein said thickness is selected such that said sheet can be coiled by hand and such that said helical spring has a sufficient spring constant to pop open said bag.

15. A method of opening and supporting a collapsible container comprising the steps of:

fabricating a plastic sheet such that when the sheet is coiled a helical spring is created having a spring constant sufficient to allow the spring to uncoil with a sufficient force to pop open the collapsible container;

coiling the plastic sheet to create a helical spring;

inserting the helical spring into an opening to the collapsible container;

releasing the helical spring to pop open the container; and maintaining the container in an open state as a function of spring action of said sheet.

16. The method of claim 15 wherein said step of fabricating comprises the step of fabricating a plastic sheet from high impact styrene.

17. The method of claim 15 wherein said step of fabricating includes the substep of selecting a width of the plastic sheet such that a overhang is created between an edge of the sheet and an edge of the opening of the container when the helical spring is released within the container.

18. The method of claim 15 wherein said step of fabricating includes the substep of selecting a length of the plastic sheet such that a first end edge of the sheet overlaps a second edge of the sheet when the helical spring is released within the container.

19. The method of claim 15 wherein the collapsible container comprises a plastic trash bag.

20. The method of claim 15 wherein the helical spring produces a pressure on a wall of the container sufficient to allow the container to stand without an external support structure.

* * * * *